US011276263B2

(12) United States Patent
Moribayashi et al.

(10) Patent No.: US 11,276,263 B2
(45) Date of Patent: Mar. 15, 2022

(54) PAPER SHEET HANDLING APPARATUS AND PAPER SHEET HANDLING METHOD

(71) Applicant: GLORY LTD., Himeji (JP)

(72) Inventors: Shigenori Moribayashi, Hyogo (JP); Yoshihiko Miyama, Hyogo (JP); Masao Hayashi, Hyogo (JP)

(73) Assignee: GLORY LTD., Himeji (JP)

( * ) Notice: Subject to any disclaimer, the term of this patent is extended or adjusted under 35 U.S.C. 154(b) by 294 days.

(21) Appl. No.: 15/760,140

(22) PCT Filed: Sep. 14, 2016

(86) PCT No.: PCT/JP2016/077113

§ 371 (c)(1),
(2) Date: Mar. 14, 2018

(87) PCT Pub. No.: WO2017/047642

PCT Pub. Date: Mar. 23, 2017

(65) Prior Publication Data

US 2018/0261031 A1 Sep. 13, 2018

(30) Foreign Application Priority Data

Sep. 16, 2015 (JP) ..... JP2015-183329

(51) Int. Cl.
*G07D 7/00* (2016.01)
*G07D 11/30* (2019.01)
(Continued)

(52) U.S. Cl.
CPC ..... *G07D 7/00* (2013.01); *G07D 11/28* (2019.01); *G07D 11/30* (2019.01); *G07D 11/32* (2019.01);
(Continued)

(58) Field of Classification Search
CPC ..... G07D 7/00; G07D 11/32; G07D 11/34; G07D 11/28; G07D 11/30; G07D 2207/00;
(Continued)

(56) References Cited

U.S. PATENT DOCUMENTS 4,556,140 A 12/1985 Okada
4,596,924 A * 6/1986 Watanabe ..... B65H 29/40 235/379
(Continued)

FOREIGN PATENT DOCUMENTS

CN 104732649 A 6/2015
EP 0 781 439 B1 7/1998
(Continued)

OTHER PUBLICATIONS

Chinese Office Action (Application No. 201680053277.8) (10 pages—dated Jul. 19, 2019).
(Continued)

*Primary Examiner* — Alexander Satanovsky
(74) *Attorney, Agent, or Firm* — Renner, Kenner, Greive, Bobak, Taylor & Weber

(57) ABSTRACT

One object is to acquire from a paper sheet circulating in the market data for updating the data for recognition. A paper sheet handling apparatus used for recognizing a paper sheet and the like includes a recognition unit that recognizes a paper sheet, an operation unit for instructing execution of a data collection processing, and a control unit that controls, in the data collection processing that is executed after an instruction operation is performed by using the operation unit, data from a paper sheet that is not correctly recognized by the recognition unit, and a memory that stores therein the data collected by the control unit.

12 Claims, 7 Drawing Sheets

(51) Int. Cl.

| | |
|---|---|
| ***G07D 11/28*** | (2019.01) |
| ***G07D 11/34*** | (2019.01) |
| ***G07D 11/32*** | (2019.01) |
| ***G07D 7/02*** | (2016.01) |
| ***G07D 7/12*** | (2016.01) |
| ***G07D 7/164*** | (2016.01) |

(52) U.S. Cl.
CPC ..... *G07D 11/34* (2019.01); *G07D 7/02* (2013.01); *G07D 7/12* (2013.01); *G07D 7/164* (2013.01); *G07D 2207/00* (2013.01)

(58) Field of Classification Search
CPC ..... G07D 7/164; G07D 7/12; G07D 7/02; G07D 9/00
See application file for complete search history.

(56) References Cited

U.S. PATENT DOCUMENTS

| | | | | |
|---|---|---|---|---|
| 5,657,847 | A | 8/1997 | Tod et al. | |
| 5,790,697 | A * | 8/1998 | Munro | B65H 3/063 382/135 |
| 6,573,983 | B1 | 6/2003 | Laskowski | |
| 6,783,061 | B2 | 8/2004 | Graef et al. | |
| 8,478,020 | B1 * | 7/2013 | Jones | G07F 19/207 382/137 |
| 8,882,109 | B2 | 11/2014 | Asada | |
| 8,929,640 | B1 | 1/2015 | Mennie et al. | |
| 2004/0050652 | A1 * | 3/2004 | Voser | G07F 9/002 194/302 |
| 2005/0060061 | A1 * | 3/2005 | Jones | G07D 11/50 700/226 |
| 2006/0163342 | A1 | 7/2006 | Carpenter et al. | |
| 2008/0236990 | A1 | 10/2008 | Ehrich et al. | |
| 2009/0183967 | A1 * | 7/2009 | Hamasaki | G07F 19/202 194/320 |
| 2011/0007960 | A1 | 1/2011 | Nireki | |
| 2013/0108142 | A1 | 5/2013 | Klein | |
| 2015/0110353 | A1 | 4/2015 | Kotani | |
| 2015/0170454 | A1 | 6/2015 | Sasaki et al. | |
| 2015/0221159 | A1 | 8/2015 | Moribayashi et al. | |

FOREIGN PATENT DOCUMENTS

| | | | | |
|---|---|---|---|---|
| EP | 1 324 278 | A1 | 7/2003 | |
| EP | 1 467 327 | A2 | 10/2004 | |
| JP | 9-115025 | A | 5/1997 | |
| JP | 2012-123696 | A | 6/2012 | |
| JP | 2013-254349 | A | 12/2013 | |
| WO | 03/040881 | A2 | 5/2003 | |
| WO | WO 2007/110276 | * | 4/2007 | G07D 11/00 |
| WO | WO 2012/029798 | A1 | 3/2012 | |

OTHER PUBLICATIONS

Extended European Search Report (Application No. 16846513.6) (7 pages—dated Apr. 12, 2019).
Australian Office Action (Application No. 2016324532) (6 pages—dated Aug. 29, 2018).
Australian Office Action (Application No. 2016324532) (6 pages—dated Feb. 22, 2019).
Office Action of Indian Application No. 201847009255 dated Jun. 26, 2020.
Office Action of Brazilian Patent Application No. 112018005062-8.

* cited by examiner

FIG.3

| RECOGNITION RESULT | USUAL BANKNOTE PROCESSING | ERROR NOTE DATA COLLECTION PROCESSING | | |
|---|---|---|---|---|
| | | ALL NOTES MODE | REJECT MODE | ACCEPT MODE |
| NORMAL NOTE | × | ○ | × | ○ |
| REJECT NOTE | × | ○ | ○ | × |

FIG.4

| ERROR NOTE DATA | | | | | | | ERROR NOTE DATA MANAGEMENT INFORMATION | |
|---|---|---|---|---|---|---|---|---|
| No. | ACQUISITION DATE AND TIME | ACQUISI-TION MODE | APPARA-TUS INFORM-ATION | INFORMATION ON DATA FOR RECOGNITION | RECOGNITION RESULT | ACQUIRED DATA | OPERATION DATE AND TIME | OPERATOR ID |
| ⋮ | | | | | | | | |
| 0019 | 2015/07/29 17:05:15 | ALL NOTES | A-001 | B001 | DENOMINATION X /GENUINE NOTE | – | 2015/08/01 16:20:31 | C001 |
| 0020 | 2015/07/30 17:15:35 | REJECT | A-001 | B001 | DENOMINATION Y /COUNTER-FEIT NOTE | – | 2015/08/01 16:20:31 | C001 |
| 0021 | 2015/08/15 17:20:05 | ACCEPT | A-001 | B001 | DENOMINATION X /GENUINE NOTE | ENTIRE SURFACE IMAGE OR PARTIAL IMAGE (VISIBLE LIGHT, INFRARED LIGHT, ULTRAVIOLET LIGHT, AND THE LIKE) THICKNESS, MAGNETISM, AND THE LIKE | – | – |
| ⋮ | | | | | | | | |

PAPER SHEET HANDLING APPARATUS AND PAPER SHEET HANDLING METHOD

TECHNICAL FIELD

The present invention relates to a paper sheet handling apparatus and a paper sheet handling method capable of recognizing a type and the like of a paper sheet.

BACKGROUND ART

Conventionally, a paper sheet handling apparatus is used for recognizing a type of a paper sheet such as a banknote, a check, and a gift certificate. By using such a paper sheet handling apparatus, authenticity recognition to determine whether a paper sheet is counterfeit can be performed based on a feature of the paper sheet. For example, a banknote handling apparatus for recognizing a denomination and authenticity of a banknote is disclosed in Patent Document 1.

In such a banknote handling apparatus, after denomination recognition is performed to recognize a denomination of the banknote based on an external appearance and the like of the banknote. Then, the authenticity recognition is performed to determine whether the banknote is genuine based on whether this banknote has a feature specific to the determined denomination. In the banknotes, various security measures such as a watermark and a latent image are use as preventive measures against counterfeiting. In the authenticity recognition, it is determined whether the banknote has the various features prepared to prevent counterfeiting, and therefore it is possible to detect a counterfeit note whose external appearance looks like a genuine banknote. In the banknote handling apparatus, information on the features of banknotes is previously prepared as data for recognition for each of the denominations. The banknote handling apparatus recognizes the denomination and the authenticity of the banknote by using the data for recognition.

CITATION LIST

Patent Document

[Patent Document 1] PCT Publication No. WO 2014/013585

SUMMARY OF INVENTION

Technical Problem

However, in the conventional technique, when a new paper sheet for which a correct recognition result cannot be obtained by the paper sheet handling apparatus is found, it is necessary to collect data about this new paper sheet. This fact puts a burden on the user of the paper sheet handling apparatus.

Specifically, if a wrong recognition result is obtained for a newly found paper sheet when it is recognized based on the existing data for recognition, it is necessary to update the data for recognition so that a correct recognition result is obtained for all the paper sheets including the newly found paper sheet. To update the data for recognition, it is necessary to investigate the newly found paper sheet and collect various data from the newly found paper sheet. Therefore, the manufacturer of the paper sheet handling apparatus who wants to investigate the newly found paper sheet, requests the user to keep the paper sheet.

For example, when a counterfeit banknote is newly found in the market, the user informs the manufacturer that a counterfeit banknote is wrongly determined as a genuine banknote in the banknote handling apparatus. In this case, the manufacturer requests the user to keep the counterfeit banknote. Alternatively, a genuine banknote may be wrongly determined as a counterfeit banknote when a printing machine and/or a printing process used to print the banknote were changed. Even in this case, the manufacturer who received a message from the user regarding the wrong determination of the banknote, requests the user to keep the banknote.

Moreover, for example, new types of paper sheets such as new checks and new gift certificates are issued one after another. Also, the designs of the existing checks and gift certificates are changed frequently in comparison with the banknotes. To correctly recognize a design-changed paper sheet or a newly issued paper sheet, such a paper sheet needs to be obtained and investigated, and it is necessary to generate data for recognition for update. Therefore, the manufacturer requests the user to obtain the design-changed paper sheet or the newly issued paper sheet.

The user who received the request from the manufacturer needs to keep the paper sheets until the manufacturer comes to collect them. Thus, there is a burden on the user. Therefore, there is a need of a method to acquire, without putting a burden on a user, various data necessary for update of data for recognition from a new paper sheet that cannot be correctly recognized by a paper sheet handling apparatus.

The present invention is made to address the problems in the conventional technology. One object of the present invention is to provide a paper sheet handling apparatus and a paper sheet handling method capable of easily collecting data for updating data for recognition from a paper sheet circulating in the market.

Means for Solving Problems

To solve the above problems and to achieve the above object, according to one aspect of the present invention, a paper sheet handling apparatus used for recognizing a paper sheet includes a recognition unit that recognizes a paper sheet; an operation unit for instructing execution of a data collection processing; a control unit that controls, in the data collection processing that is executed after an instruction operation is performed by using the operation unit, the recognition unit to collect data from the paper sheet that is not correctly recognized by the recognition unit; and a memory that stores therein the data collected by the control unit.

In the above paper sheet handling apparatus, the operation unit is used to instruct to perform the data collection processing in a reject mode, and in the accept mode, the control unit stores in the memory the data collected from a paper sheet recognized to be rejected.

In the above paper sheet handling apparatus, the operation unit is used to instruct to perform the data collection processing in an accept mode, and in the accept mode, the control unit stores in the memory the data collected from a paper sheet recognized not to be rejected.

In the above paper sheet handling apparatus, if a first paper sheet, from which the data is collected by the recognition unit first after starting the data collection processing, is recognized to be rejected, the control unit stores in the memory the data collected from paper sheets recognized to be rejected. If a first paper sheet, from which the data is collected by the recognition unit first after starting the data collection processing, is recognized not to be reject, the control unit stores in the memory the data collected from paper sheets recognized not to be rejected.

In the above paper sheet handling apparatus, the control unit collects the data from only a predetermined number of paper sheets, including a first paper sheet from which data is collected by the recognition unit after starting the data collection processing, and stores collected data in the memory.

The above paper sheet handling apparatus further includes a display unit that displays information about the paper sheet. The control unit starts the data collection processing and displays on the display unit information about each of the paper sheets from which the data is collected by the recognition unit, and stores in the memory the data of the paper sheet selected by using the operation unit from among the paper sheets displayed on the display unit.

In the above paper sheet handling apparatus, the control unit performs an authentication process of an operator, and permits an operation to movie and/or copy the data stored in the memory only when the operator is authenticated for the operation.

In the above paper sheet handling apparatus, the control unit encrypts the data when storing the data in the memory.

In the above paper sheet handling apparatus, the control unit monitors an operation to move or copy the data stored in the memory and records information about the operation.

In the above paper sheet handling apparatus, the control unit deletes the data from the memory after the data stored in the memory is collected by a manufacturer of the paper sheet handling apparatus.

According to another aspect of the present invention, a paper sheet handling apparatus used for recognizing a paper sheet includes a memory in which data for recognition used to recognize each of a plurality of types of paper sheets has been stored; a recognition unit that recognizes a paper sheet based on the data for recognition; an operation unit for instructing execution of data collection processing; and a control unit that controls, in the data collection processing that is executed after an instruction operation is performed by using the operation unit, the recognition unit to collect data from a paper sheet that is not correctly recognized by the recognition unit, determines whether it is possible to correctly recognize each of the paper sheets by the recognition unit if the data for recognition is updated based on collected data, and updates the data for recognition based on the collected data upon determining that it is not possible to correctly recognize each of the paper sheets.

In the above paper sheet handling apparatus, when the control unit determines that it is not possible to correctly recognize each of the paper sheets by the recognition unit even by updating the data for recognition based on the data collected from the paper sheet that is not correctly recognized, the control unit does not update the data for recognition and stores the data collected from the paper sheet that is not correctly recognized.

In the above paper sheet handling apparatus, in the data collection processing, the control unit acquires dimension data from the paper sheet that is not correctly recognized by the recognition unit, and updates the data for recognition based on the dimension data.

In the above paper sheet handling apparatus, in the data collection processing, the control unit acquires character data from the paper sheet that is not correctly recognized by the recognition unit, and updates the data for recognition based on the character data.

According to still another aspect of the present invention, a paper sheet handling method implemented in a paper sheet handling apparatus used for recognizing a paper sheet in a shop includes switching a processing mode to a data collection processing mode upon receiving an operation from an employee of the shop; collecting data from a paper sheet that is not correctly recognized in the paper sheet handling apparatus; and prohibiting moving and copying of the data collected from the paper sheet to outside of the paper sheet handling apparatus, and retaining the data inside the paper sheet handling apparatus until the data is collected by a manufacturer of the paper sheet handling apparatus.

Advantageous Effects of Invention

According to the present invention, the paper sheet handling apparatus is usually used to perform the recognition and counting of the paper sheet and the sorting of the paper sheet by type, and when a paper sheet that is not correctly recognized is found, the paper sheet handling apparatus is used to perform the data collection processing. Accordingly, data can be collected from this paper sheet and the collected data can be stored in the apparatus. Because the user of the paper sheet handling apparatus can execute the data collection processing by operating the operation unit by himself, there is no need for the user to retain the actual paper sheet until the manufacturer comes there. Moreover, even if the actual error note is not present, the manufacturer can generate updated data of the data for recognition by collecting the data that is collected from the paper sheet and retained in the paper sheet handling apparatus.

According to the present invention, when it is possible to correctly recognize all the paper sheets by updating the data for recognition used to recognize the paper sheet in the paper sheet handling apparatus based on the data collected from the paper sheet that is not correctly recognized, the data for recognition can be updated by the apparatus. By doing so, in the paper sheet handling apparatus, all the paper sheets can be correctly recognized without waiting for the investigation of the paper sheet and the update of the data for recognition by the manufacturer. There is no need for the manufacturer to investigate the paper sheet and update the data for recognition.

BRIEF DESCRIPTION OF DRAWINGS

FIG. 3 is a view showing types of banknote handling performed in the banknote handling apparatus.

FIG. 4 is a view showing examples of error note data and error note data management information.

DESCRIPTION OF EMBODIMENTS

Exemplary embodiments of a paper sheet handling apparatus and a paper sheet handling method according to the present invention are explained below in detail by referring to the accompanying drawings. The paper sheet handling apparatus according to the present invention can be used to handle various paper sheets in a financial institution such as a bank, a shop of a retail store and the like. A type of paper sheet that can be handled by the paper sheet handling apparatus is not particularly limited. In the following, a banknote handling apparatus that recognizes and counts banknotes, and a money depositing apparatus that recognizes and counts banknotes and gift certificates, and accepts depositing thereof are explained below as examples. In the present embodiment, a person who usually uses the paper sheet handling apparatus is described as a "user". The user includes an employee and the like who uses the paper sheet handling apparatus installed in a shop such as a bank, a retail store, and the like. A person who guarantees a normal operation of the paper sheet handling apparatus to the user is described as a "manufacturer". The manufacturer includes an employee of a manufacturer of the paper sheet handling apparatus, a person of a company that handles sales of the paper sheet handling apparatus, a person of a company that handles maintenance and inspection of the paper sheet handling apparatus, and the like.

First Embodiment

Figure 1:
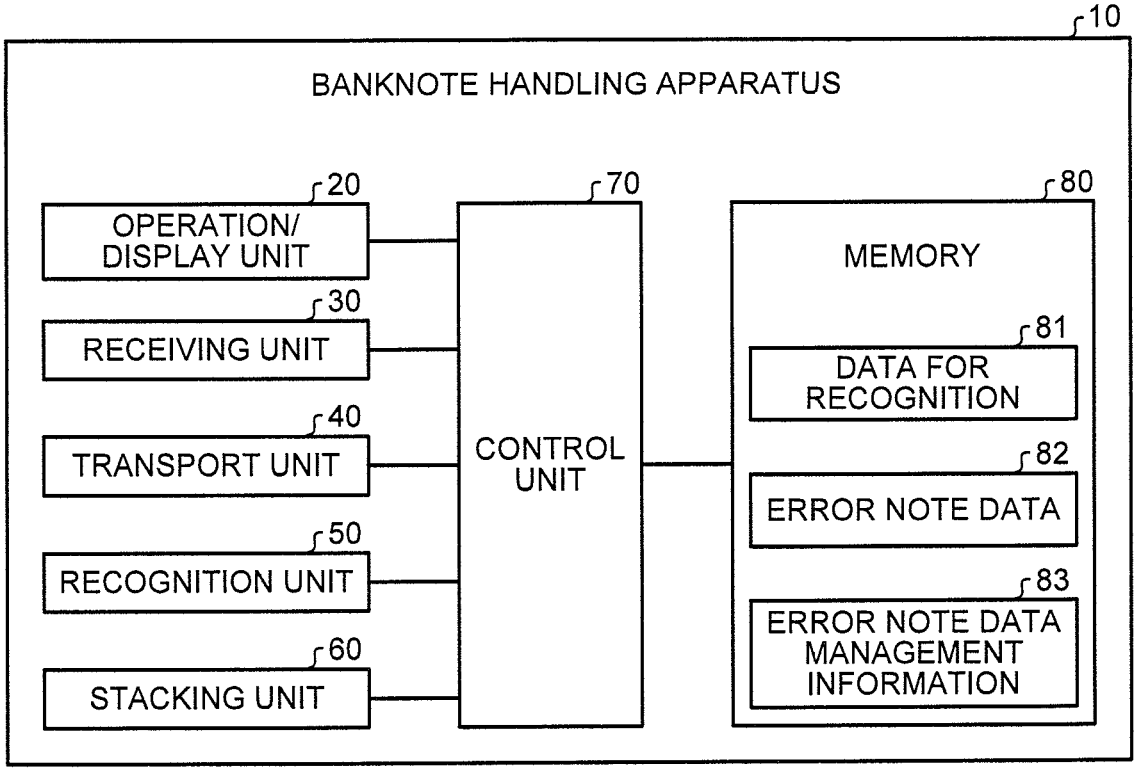
FIG. 1 is a schematic block diagram of a functional configuration of a banknote handling apparatus according to a first embodiment.
Figure 2:
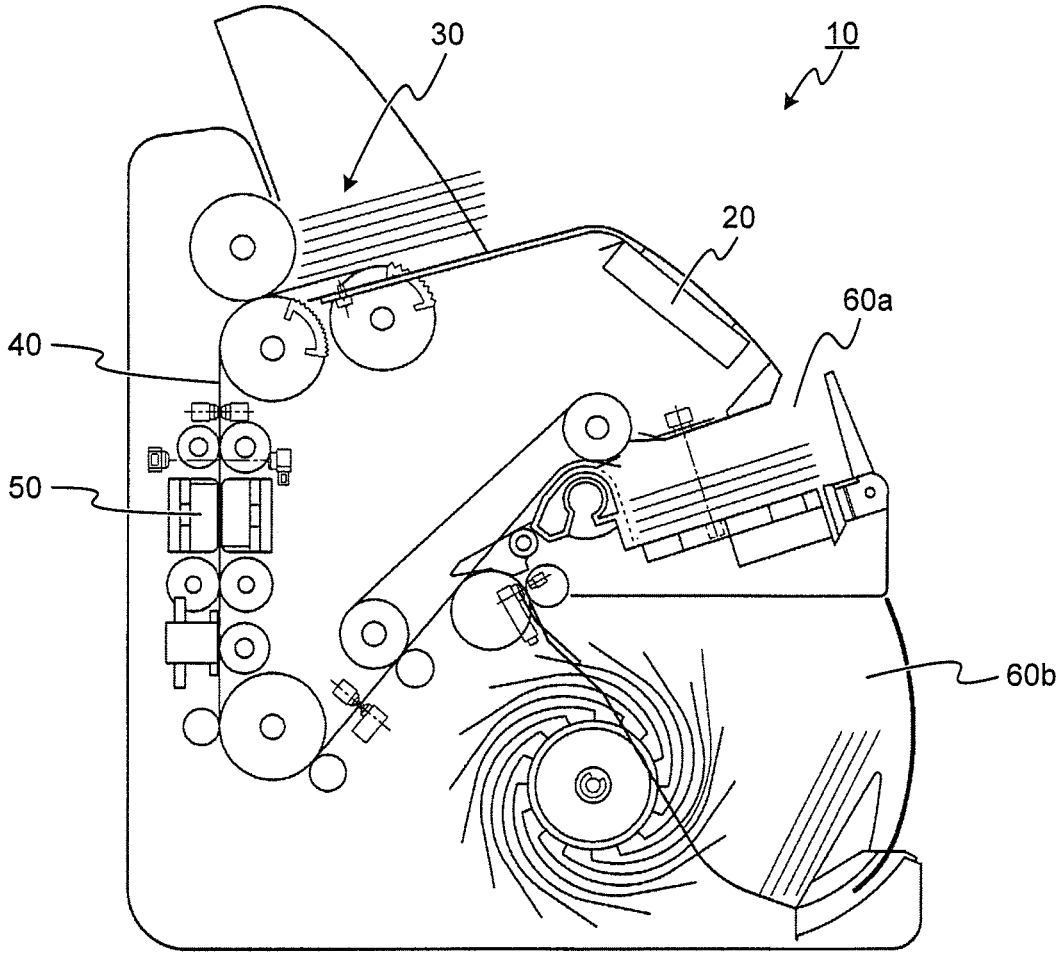
FIG. 2 is a schematic cross section showing an internal configuration of the banknote handling apparatus when seen from the left side.

At first, an example of a banknote handling apparatus (paper sheet handling apparatus) that handles a banknote is explained below. FIG. 1 is a schematic block diagram of a functional configuration of a banknote handling apparatus 10 according to a first embodiment. FIG. 2 is a schematic cross section showing an internal configuration of the banknote handling apparatus 10 when seen from the left side. As shown in FIG. 1, the banknote handling apparatus 10 includes an operation/display unit 20, a receiving unit 30, a transport unit 40, a recognition unit 50, a stacking unit 60, a memory 80, and a control unit 70 that controls all these components.

As shown in FIG. 2, the receiving unit 30 for putting the banknotes to be recognized and counted is arranged in an upper part of a front surface side (right side in FIG. 2) of the banknote handling apparatus 10. Below the receiving unit 30, the operation/display unit 20 is arranged. The operation/display unit 20 is used to perform a setting operation and/or an instruction operation relating to the banknote processing while looking at information displayed on a screen. A stacker 60*b* for stacking a banknote is arranged in a lower front surface of the apparatus. Above the stacker 60*b*, a reject unit 60*a* for stacking a reject banknote is arranged. The reject unit 60*a* and the stacker 60*b* are open on the apparatus front surface side, and the banknotes stacked therein can be taken out from the opening.

The reject unit 60*a* and the stacker 60*b* are included in the stacking unit 60 shown in FIG. 1. The transport unit 40 includes a transport path, banknote detecting sensors arranged at many places in the transport path, and a diverter that changes a transport destination of the banknote from a main transport path, which leads from the recognition unit 50 to the reject unit 60*a*, to a divergence transport path which leads to the stacker 60*b*. Inside the stacker 60*b*, a stacking wheel is arranged. The stacking wheel receives banknotes discharged one by one from the divergence transport path. The stacking wheel receives each banknote between two blades thereof and rotates thereby stacking the banknotes in an aligned manner inside the stacker 60*b*.

The recognition unit 50 includes a line sensor for capturing a visible light image, a thickness sensor for measuring a thickness, and a magnetic sensor for measuring magnetic characteristics of each banknote. The line sensor captures banknote images by using a light source that irradiates the banknote with a light of a predetermined wavelength. For example, an ultraviolet light image is captured by irradiating the banknote with an ultraviolet light, and an infrared light image is captured by irradiating the same banknote with an ultraviolet light. The recognition unit 50 acquires data, such as the image, the thickness, the magnetism, of an entire surface of the banknote by scanning with each of the sensors the banknote being transported by the transport unit 40. Moreover, the light source and the line sensor are provided on each of the front surface side and the back surface side of the banknote transported by the transport unit 40. Accordingly, it is possible to acquire a reflection image of the entire front surface of the banknote, a reflection image of the entire back surface of the banknote, and transmission images of the entire surface of the banknote. However, there is no limitation on the type of the sensors and a measurement area of each of the sensors of the recognition unit 50. The sensors to be used, the arrangement positions of the sensors, a method of acquiring the data, and the like, can be suitably determined depending on the type of the banknotes that are the recognition target, the type of the data to be acquired from the banknotes, a use object of the banknote handling apparatus 10, and the like.

The recognition unit 50 recognizes the denomination of the banknote based on, for example, the visible light image of the banknote. Moreover, the recognition unit 50 recognizes the authenticity of the banknote based on, for example, features appearing in the visible light image, the size, the thickness, the magnetic characteristics, the ultraviolet light characteristics, the infrared light characteristics, and the like of the banknote. The recognition unit 50 also has a function to determine the fitness of the banknote from a feature appearing in the thickness and the image of the banknote. The position of the banknote on the transport path is detected by the banknote detecting sensors arranged in the transport path. The control unit 70 detects the position of the banknote on the transport path and controls the recognition unit 50 so that the recognition unit 50 can acquire from a predetermined region on the banknote various data at a timing when the banknote passes through the recognition unit 50.

Based on the recognition result obtained by the recognition unit 50, the control unit 70 determines which between the reject unit 60*a* and the stacker 60*b* shall be the transportation destination of the banknote. Moreover, the control unit 70 controls the transport unit 40 and controls the diverting operation of the diverters while detecting the position of the banknote on the transport path so that the banknote is transported to and stacked in the transport destination determined earlier.

The memory 80 is constituted by a nonvolatile semiconductor memory and the like. The memory 80 is used to store data for recognition 81, error note data 82, error note data management information 83, and the like. The memory 80 is also used for storing various data such as computer programs and/or setting information used by the control unit 70, and the like.

The data for recognition 81 includes data used by the recognition unit 50 when recognizing the denomination, the authenticity, the fitness, and the like of the banknote. The error note data 82 and the error note data management information 83 are data relating to the error note that is a banknote for which a correct recognition result was not obtained by the recognition unit 50. The details will be given later. The data for recognition 81, the error note data 82, and the error note data management information 83 are stored in the memory 80 in an encrypted state so that a person who is not the manufacturer cannot read the contents of the data.

Although not shown in FIG. 1, the banknote handling apparatus 10 can be connected to an external apparatus such as a computer. The data stored in the memory 80 can be moved or copied from the memory 80 to the external apparatus. The banknote handling apparatus 10 has a card slot in which a portable storage medium such as a memory card can be removably set. The data stored in the memory 80 can be moved or copied to the memory card. However, the user cannot move or copy the data stored in the memory 80. Only the manufacturer who performs a predetermined authentication process by operating the operation/display unit 20 and is authenticated as an authorized manufacturer can move or copy the data stored in the memory 80.

A banknote processing performed by the banknote handling apparatus 10 is explained below. FIG. 3 is a view showing types of the banknote processing performed by the banknote handling apparatus 10. In the banknote handling apparatus 10, an error note data collection processing (data collection processing) can be performed in addition to the usual banknote processing performed conventionally. The error note data collection processing has three selectable modes of an all notes mode, a reject mode, and an accept mode.

A normal note shown in FIG. 3 is a banknote to be stacked in the stacker 60*b* during the usual banknote processing in which banknotes desired to be counted are stacked in the stacker 60*b*. A reject note is a banknote to be rejected in the reject unit 60*a* during the usual banknote processing. An error note is a banknote for which a correct recognition result was not obtained by the recognition unit 50. The error note includes, for example, a banknote determined to be a genuine note by the recognition unit 50 though it is actually a counterfeit note, and a banknote determined to be a counterfeit note by the recognition unit 50 though it is actually a genuine note. In FIG. 3, "Y" (for yes) represents a case in which the data acquired from the banknote is stored in the memory 80 after completing the recognition process of the banknote. In "N" (for no) represents a case in which the data is deleted without storing in the memory 80 after completing the recognition process of the banknote.

The usual banknote processing is explained first. The usual banknote processing is the banknote processing performed conventionally in which the banknote put on the receiving unit 30 is recognized and counted. For example, in the banknote processing to count the number of banknotes and to calculate a total amount of the banknotes, the banknotes put on the receiving unit 30 are fed one by one into the transport path in the apparatus, and each banknote is transported by the transport unit 40. The recognition unit 50 arranged in the middle of the transport path recognizes, by using the data for recognition 81 stored in the memory 80, the denomination, the authenticity, the fitness, and the like of the banknote transported by the transport unit 40. With this process, the banknote handling apparatus 10 can obtain the number and the amount of the banknotes by denomination, and the number and the total amount of all the banknotes.

The control unit 70 determines between the reject unit 60*a* and the stacker 60*b* the transport destination of the banknote depending on the recognition result obtained by the recognition unit 50. A banknote whose denomination and authenticity cannot be recognized, a counterfeit banknote (counterfeit note), a banknote that may be counterfeit (suspect note), and the like are transported to the reject unit 60*a* as the reject notes. On the other hand, the genuine banknote (genuine note) is transported to the stacker 60*b* as the normal note. When it is set that the fitness of each of banknotes is to be determined while counting banknotes, the banknotes are separated into a bad banknote (unfit note) having a high degree of damage and/or soil compared to a previously prepared determination criteria and a better banknote (fit note) having a low degree of damage and/or soil compared to the determination criteria. The unfit note is stacked in the reject unit 60*a* as the reject note, and the fit note is stacked in the stacker 60*b* as the normal note. As shown in FIG. 3, the data acquired by the recognition unit 50 for recognizing the banknote during the usual banknote processing is deleted after completion of the recognition process irrespective of whether the banknote is the reject note or the normal note.

The error note data collection processing is explained next. The error note data collection processing is the processing to be performed when the error note is found by the banknote handling apparatus 10. The data necessary to update the data for recognition 81 can be collected from the error note by performing the error note data collection processing. The error note data collection processing is concretely explained below by taking a case in which a genuine note is mistakenly recognized to be a counterfeit note, and a case in which a counterfeit note is mistakenly recognized to be a genuine note as examples.

When performing the error note data collection processing, an operator operates the operation/display unit 20 of the banknote handling apparatus 10 to select a processing mode from among the three processing modes of the all notes mode, the reject mode, and the accept mode shown in FIG. 3. The difference between each of the processing modes will be explained later.

Like at the time of the usual banknote processing, the error note is put on the receiving unit 30 when performing the error note data collection processing. Specifically, when a plurality of error notes is put on the receiving unit 30 and the processing is started, the error notes put on the receiving unit 30 are fed one by one to the transport path in the apparatus, and the error notes are transported by the transport unit 40. The recognition unit 50 uses all the sensors, such as the line sensor, the thickness sensor, and the magnetic sensor, and acquires data from the entire front surface and the entire back surface of the error note being transported by the transport unit 40. In the usual banknote processing, depending on the denomination of processing target banknote, it is possible that the data is acquired only by a sensor necessary to recognize the processing target banknote, or that the data is acquired only from a part of the banknote. However, in the error note data collection processing, all data that can be acquired by using all the sensors are acquired from the entire surface of the error note.

By using the data acquired from the error note, like at the time of the usual banknote processing, the recognition unit 50 performs the recognition process to recognize the denomination, the authenticity, the fitness, and the like of the error note based on the data for recognition 81 stored in the memory 80.

When the recognition result is obtained by the recognition unit 50, like at the time of the usual banknote processing, the control unit 70 determines the transport destination of each of the error notes between the reject unit 60*a* and the stacker 60*b* depending on the recognition result of the error note. That is, the control unit 70 determines whether the error note is the reject note or is the normal note. Like at the time of the usual banknote processing, when the denomination and authenticity of the error note cannot be recognized and/or when the error note is recognized as the counterfeit note or the suspect note, this error note is stacked in the reject unit 60*a* as the reject note, whereas the error note recognized as the genuine note is stacked in the stacker 60*b* as the normal note.

In the error note data collection processing, in which the data is acquired from the error note for which a wrong authentication determination is obtained, fitness determination is not performed. Accordingly, a genuine note, even if it is an unfit note, is stacked in the stacker 60*b* as the normal note, and a counterfeit note, even if it is a fit note, is stacked in the reject unit 60*a* as the reject note.

In this manner, while stacking each of the error notes in any one of the reject unit 60*a* and the stacker 60*b* depending on the recognition result about the authenticity of the error note, the data collected from each of the error notes by using all the sensors of the recognition unit 50 is stored in the memory 80 as the error note data 82. The control unit 70 selects the data to be stored in the memory 80 depending on the processing mode.

Specifically, as shown in FIG. 3, in the all notes mode, both the data of the normal note and the data of the reject note are stored in the memory 80. In the reject mode, only the data of the reject note is stored in the memory 80, and the data of the normal note is discarded. In the accept mode, only the data of the normal note is stored in the memory 80, and the data of the reject note is discarded.

For example, if there is a requirement to collect the data from all the banknotes irrespective of whether the banknotes are the reject notes or the normal notes, the error note data collection processing is performed in the all notes mode. If there is a requirement to collect the data from the error note which is wrongly determined to be the genuine note though it is actually the counterfeit note, that is, if there is a requirement to collect the data from the error note that is mistakenly accepted as the genuine note due to determination error, the error note data collection processing is performed in the accept mode. If there is a requirement to collect the data from the error note which is wrongly determined to be the counterfeit note though it is actually the genuine note, that is, if there is a requirement to collect the data from the error note that is mistakenly rejected as the counterfeit note due to determination error, the error note data collection processing is performed in the reject mode.

The error note data 82 stored in the memory 80 is encrypted so that the user cannot read the contents of the data. To ensure the security of the error note data 82, the user cannot move or copy the error note data 82 stored in the memory 80, and only a manufacturer who is authorized by operating the operation/display unit 20 can move or copy the data. The manufacturer collects the error note data 82 from the banknote handling apparatus 10 and investigates the details of the collected data, and generates updated data of the data for recognition 81 by which the correct recognition result is obtained for each of all banknotes including the error notes. Then, the data for recognition 81 in the memory 80 is updated by using the update data generated by the manufacturer. Accordingly, all the banknotes are correctly recognized by the banknote handling apparatus 10. Note that, other than permitting the manufacturer to move and copy the data, it is allowable to permit the manufacturer one of to move the data and to copy the data.

For example, when the counterfeit note is newly found in the market, and it is wrongly determined as the genuine note by the banknote handling apparatus 10, the user performs the error note data collection processing in the all notes mode or the accept mode to process this counterfeit note as the error note. Accordingly, various data are collected from the error note that is wrongly determined as the normal note, and the collected data can be stored in the memory 80 as the error note data 82. The manufacturer collects the error note data 82 from the banknote handling apparatus 10 and investigates the details of the data, and generates updated data of the data for recognition 81 by which this error note can be recognized as the counterfeit note.

For example, if a banknote is wrongly determined as the counterfeit note by the banknote handling apparatus 10 though it is clearly the genuine note, the user performs the error note data collection processing in the all notes mode or the reject mode to process this genuine note as the error note. Accordingly, various data are collected from the error note that is wrongly determined as the reject note, and the collected data can be stored in the memory 80 as the error note data 82. The manufacturer collects the error note data 82 from the banknote handling apparatus 10 and investigates the details of the data, and generates updated data of the data for recognition 81 by which this error note can be recognized as the genuine note. The banknotes of each country are printed, for example, in the Mint Bureau or a printing bureau. When the printing machine or the ink used to print the banknotes is changed, a slight variation may occur in the banknotes printed before and after the change, and the banknotes printed after the change may be mistakenly determined as the counterfeit notes by the banknote handling apparatus 10. In such a case, the user performs the error note data collection processing to collect the data from the banknote after the change. The manufacturer collects this data and generates the updated data of the data for recognition 81. Based on this updated data, the correct recognition result can be obtained by the banknote handling apparatus 10.

In the banknote handling apparatus 10, even in the error note data collection processing, like in the usual banknote processing, the data can be collected from each of a plurality of the banknotes put on the receiving unit 30. Accordingly, in one processing, the data can be collected from a plurality of error notes.

The processing target of the error note data collection processing is not limited to the error note. That is, the data can be collected from not only the error note but also from the banknote (usual note) for which the correct recognition result is obtained. When the banknotes put on the receiving unit 30 as the processing target of the error note data collection processing include the usual note, the error note data 82 will include the data of the usual note.

For example, if there is the error note that is mistakenly recognized as the counterfeit note and rejected in the reject unit 60*a* though it is actually the genuine note and also there is the usual note that is correctly recognized as the genuine note and stacked in the stacker 60*b*, there is a case where both these banknotes cannot be distinguished by eyes from their external appearances. In this case, by processing both the error note and the usual note at one time in the all notes mode, data can be collected from both the error note which is wrongly determined as the counterfeit note and stacked in the reject unit 60*a*, and the usual note which is correctly determined and stacked in the stacker 60*b*. Accordingly, the manufacturer can generate the updated data of the data for recognition 81 while comparing the data of the error note and the data of the usual note.

Alternatively, for example, first, data is collected in the reject mode or the accept mode from the error note, and then, data is collected in the all notes mode from a plurality of the usual notes for which the correct recognition result is obtained. In this case, the manufacturer recognizes that the data stored in the reject mode or the accept mode is the data of the error note, and the data stored in the all notes mode is the data of the usual note, and can generate the updated data of the data for recognition 81 based on a comparison of both the data.

In the banknote handling apparatus 10, the number of banknotes from which the data can be collected in one error note data collection processing can be limited. It is rare to find many error notes at one time. Therefore, for example, the number of banknotes from which the data can be collected in one error note data collection processing can be set to one. For example, when performing the usual banknote processing after having performed the error note data collection processing, there is a case where the user forgets to perform an operation to change the processing mode from the error note data collection processing to the usual banknote processing, puts a plurality of the banknotes on the receiving unit 30, and wrongly starts the error note data collection processing. In this case, because the error note data collection processing will be stopped after processing only one banknote, it can be prevented that unnecessary data is collected from a large number of banknotes.

The contents of the error note data 82 and the error note data management information 83 stored in the memory 80 are explained below. FIG. 4 is a view showing examples of the error note data 82 and the error note data management information 83.

The error note data 82 is explained first. As shown in FIG. 4, the error note data 82 includes, in addition to "acquired data" which is the data acquired from the error note by using each of the sensors of the recognition unit 50, "No.", "acquisition date and time", "acquisition mode", "apparatus information", "information on the data for recognition", and "recognition result".

The "No." is a management number used to manage the data, and one management number is allocated to each banknote processed in the banknote handling apparatus 10. The "acquisition date and time" is the date and time on which the data was collected from the banknote by the recognition unit 50. The "acquisition mode" is the processing mode of the error note data collection processing when the data was collected from the banknote. The "apparatus information" is information for identifying the apparatus that collected the data. The "apparatus information" includes information about a type and a production number of the banknote handling apparatus 10. The "information on the data for recognition" is information indicating a version of the data for recognition 81 stored in the memory 80. The "information on the data for recognition" is information used to identify the data for recognition 81 used by the recognition unit 50 to recognize the banknote. The "recognition result" is information indicating the recognition result of the banknote obtained by the recognition unit 50.

The "acquired data" is data collected by the recognition unit 50 in the error note data collection processing. With respect to the acquired data, the types of data are shown in FIG. 4; however, in reality, image data and/or measurement data are stored. The acquired data includes the thickness data acquired from the entire surface of the banknote by the thickness sensor and the magnetic data acquired from the entire surface of the banknote by the magnetic sensor. Moreover, the acquired data includes the reflection image of the entire front surface of the banknote, the reflection image of the entire back surface of the banknote, and the transmission images of the entire surface of the banknote acquired by using the line sensor. An image corresponding to each of the light can be acquired by changing the wavelength of the light output from the light source, such as the visible light, the ultraviolet light, and the infrared light.

In an initial setting, as the acquired data, it is set to collect all the data that can be acquired by using all the sensors of the recognition unit 50. However, the type of the data to be acquired and the acquisition method of the data can be limited by changing the setting. For example, the type of the data to be acquired and the acquisition method of the data can be set by currency, or can be set by denomination.

Specifically, for example, assume that, for a banknote of a certain currency, a banknote of a certain denomination, and the like, a security mark having predetermined ultraviolet light characteristics is arranged in a partial area on the front surface (one side), and there is no area that has any ultraviolet light characteristic in the remaining area. In this case, it is set that a partial area on the banknote, which includes the security mark on the banknote even if there is a printing variation, is specified and the ultraviolet light image is acquired only from the specified partial area. Similarly, for each of the visible light image and the infrared light image, it can be set that a predetermined partial area is specified and the image can be acquired only from the partial area. Moreover, a resolution of the acquired image can be specified. For example, it can be set that while an image having a low resolution and a low gradation is acquired in the usual banknote processing, the resolution and the gradation of the acquired image is changed to acquire a high resolution and a high gradation image in the error note data collection processing. Moreover, the acquisition method of the image can be set that the resolution, the gradation, and the like are changed depending on the type of an image to be acquired.

Also, for example, assume that, for a banknote of a certain currency, a banknote of a certain denomination, and the like, predetermined magnetic characteristics are detected only from a part of the banknote. In this case, it is set that a partial area including this part is specified and the measurement of magnetism is performed only in the specified partial area. Similarly, assume that, for a banknote of a certain currency, a partial area of the banknote is thicker than other area of the banknote. In this case, it is set that the measurement of thickness is performed only in this partial area. With respect to the thickness data and the magnetic data, like in the case of the image, it can be set that a sampling interval, the resolution (number of bits) of data, and the like are changed between the data measured during the usual banknote processing and the data measured during the error note data collection processing. Moreover, the acquisition method of the data can be set that the sampling interval, the resolution, and the like, are changed for each of the measurement areas.

In the banknote handling apparatus 10, a transport speed of the banknote by the transport unit 40 can be set different in the usual banknote processing and in the error note data collection processing. When performing the usual banknote processing by the banknote handling apparatus 10, there is a requirement to handle a large number of banknotes at high speed; therefore, the recognition unit 50 acquires data from the banknote being transported at high speed and performs a recognition process based on the acquired data. In contrast, in the error note data collection processing, preference needs to be given to collect precision data from the error note rather than the processing speed; therefore, the transport speed of the banknote can be set lower in comparison with the transport speed in the usual banknote processing.

Specifically, when collecting the data based on the initial setting, setting prepared by currency, setting prepared by denomination in the error note data collection processing, the control unit 70 recognizes the type, the resolution, the sampling interval, and the like of the data to be acquired, and sets the transport speed of the banknote by the transport unit 40 so that all the data can be acquired with high precision. For example, the control unit 70 calculates the transport speed of the banknote based on a resolution of the banknote image to be acquired, a response speed of the line sensor that captures the image of the banknote, and the like. Moreover, for example, the control unit 70 calculates the transport speed of the banknote based on a sampling interval of the measurement by the thickness sensor and the magnetic sensor, a response speed of each of the sensors, and the like. The transport speed of the transport unit 40 is set at the lowest speed among these calculated transport speeds.

The error note data management information 83 shown in FIG. 4 is explained below. The error note data management information 83 includes "operation date and time" and "operator ID". The "operation date and time" indicates the date and time on which the error note data 82 was moved or copied in the external apparatus connected to the banknote handling apparatus 10, or in the memory card set in the card slot of the banknote handling apparatus 10. The "operator ID" indicates ID information of an operator acquired in the authentication process that is performed when the data was moved or copied.

In the banknote handling apparatus 10, execution of the authentication process is requested before permitting moving or copying of the error note data 82, and only an authorized manufacturer passed the authentication process can perform the moving or copying of the data. The control unit 70 records operator information input in the authentication process as an operator ID of the error note data management information 83.

The example of FIG. 4 shows that the acquired data is stored as the error note data 82 of No. 0021 in the memory 80. However, for the error note data 82 of No. 0019 and No. 0020, the acquired data was moved by the operator having an operator ID "C001" on the recorded date and time shown under the "operation date and time", and therefore the acquired data is no more present in the memory 80. Thus, when the operation to move or copy the error note data 82 in the banknote handling apparatus 10 is performed, by recording the operation date and time and the operator ID, as the operation history, the security of the error note data 82 is ensured.

With respect to the data examples No. 0019 and 0020 shown in FIG. 4, a part of the information included in the error note data 82, such as the acquisition date and time and the acquisition mode are retained even after the operation to move the error note data 82 is performed. However, it can be set that when the data is moved, the entire error note data 82 is deleted, and only the error note data management information 83 is retained. Alternatively, it can be set that upon elapse of a predetermined number of days after the error note data 82 is moved or copied, the entire data is automatically deleted from the memory 80. Moreover, it can be set that after the error note data 82 is moved or copied, the data is retained in the memory 80 without deleting until a predetermined manual operating is performed. Moreover, it can be set that, even to an authorized manufacturer, the control unit 70 does not permit copying of the error note data 82 but permits only moving of the data.

In the above explanation, the banknote from which the error note data 82 is to be collected is selected by selecting one processing mode among the all notes mode, the reject mode, and the accept mode; however, the method of selecting the banknote from which the data is to be collected is not limited to this method. For example, it can be set that, when the first banknote fed in the apparatus from the receiving unit 30 and recognized in the recognition unit 50 is the reject note, only the error note data 82 collected from the reject note is stored in the memory 80 and the data of other banknote is discarded, and when the first banknote is the normal note, only the error note data 82 collected from the normal note is stored in the memory 80 and the data of other banknote is discarded. Moreover, for example, it can be set that after having finished the recognition process of all the banknotes put on the receiving unit 30 by the recognition unit 50, information such as the recognition result of all the banknotes is displayed on the screen of the operation/display unit 20, only the error note data 82 of the banknote selected by using the operation/display unit 20 is stored in the memory 80, and the error note data 82 of the non-selected banknotes is discarded.

Thus, in the banknote handling apparatus 10 according to the present embodiment, in addition to the usual banknote processing, the error note data collection processing can be performed and the detailed data of the error note can be acquired. The data acquired by the recognition unit 50 in the usual banknote processing is deleted after the completion of the recognition process; however, the data acquired from the error note by the recognition unit 50 in the error note data collection processing can be stored in the memory 80 as the error note data 82. The error note data 82 is stored in the memory 80 until it is collected by the manufacturer.

The user of the banknote handling apparatus 10 can himself perform the error note data collection processing, and the user does not have to keep the error note until the manufacturer of the banknote handling apparatus 10 comes to the shop where the user works. The error note data 82 acquired by the user by operating the banknote handling apparatus 10 is stored in the memory 80 in the encrypted state. Only an operator authorized by performing the authentication process is permitted to move or copy the error note data 82. The operation history including the operator ID and the like is recorded in the memory 80 when moving or copying of the data is performed. Accordingly, the security of the error note data 82 is ensured.

The manufacturer of the banknote handling apparatus 10 collects the error note data 82 from the banknote handling apparatus 10 and investigates the details of the data. Therefore, even if the actual paper error note is not present, the manufacturer can generate the updated data of the data for recognition 81, so that the banknote that was determined to be the error note can be correctly recognized in the banknote handling apparatus 10. The user updates the data for recognition 81 stored in the memory 80 of the banknote handling apparatus 10, with the updated data of the data for recognition 81 generated by the manufacturer. Accordingly, the correct recognition result can be obtained from all the banknotes including the banknote that was determined to be the error note.

Second Embodiment

Figure 5:
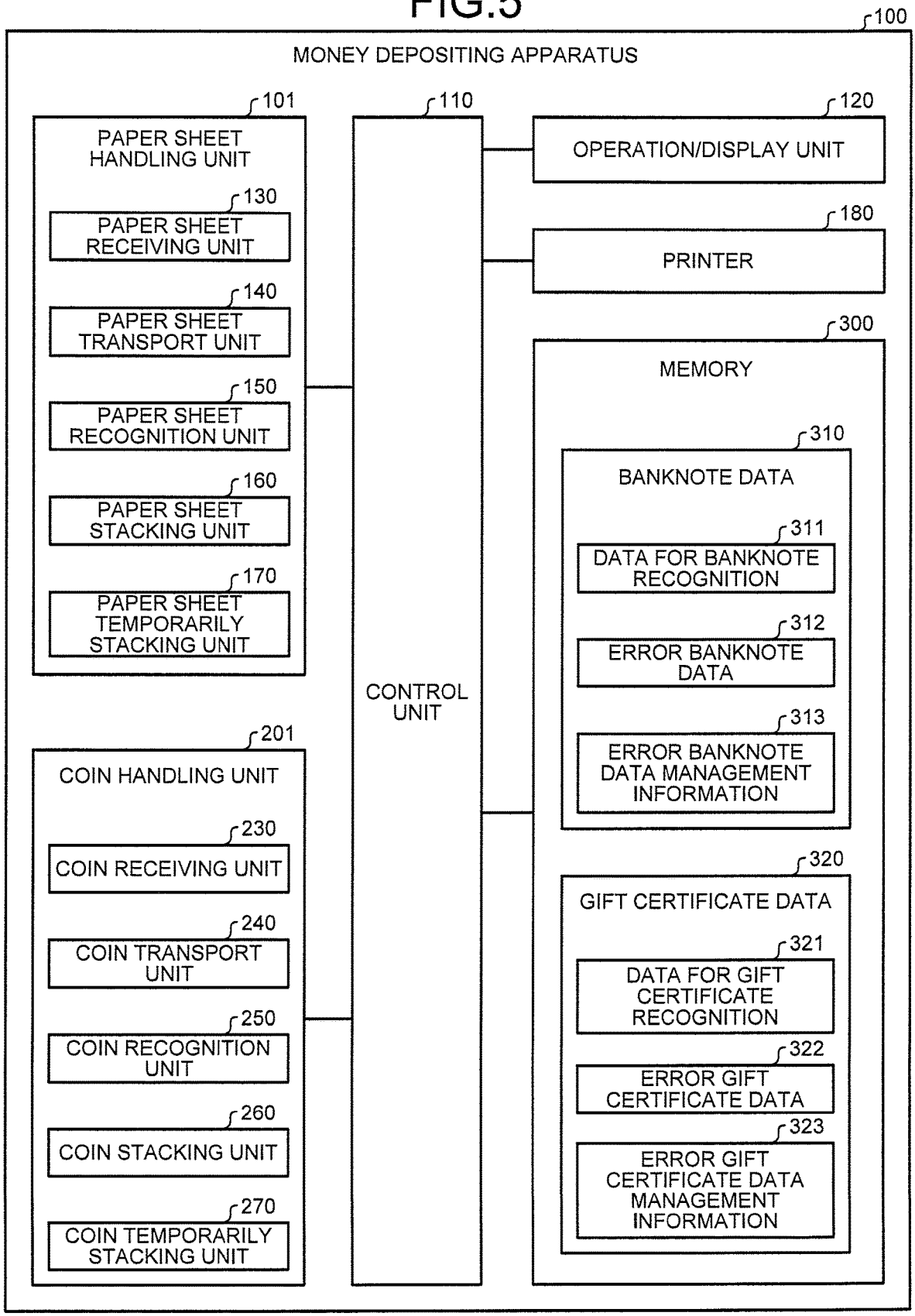
FIG. 5 is a block diagram of a functional configuration of a money depositing apparatus according to a second embodiment.
Figure 6:
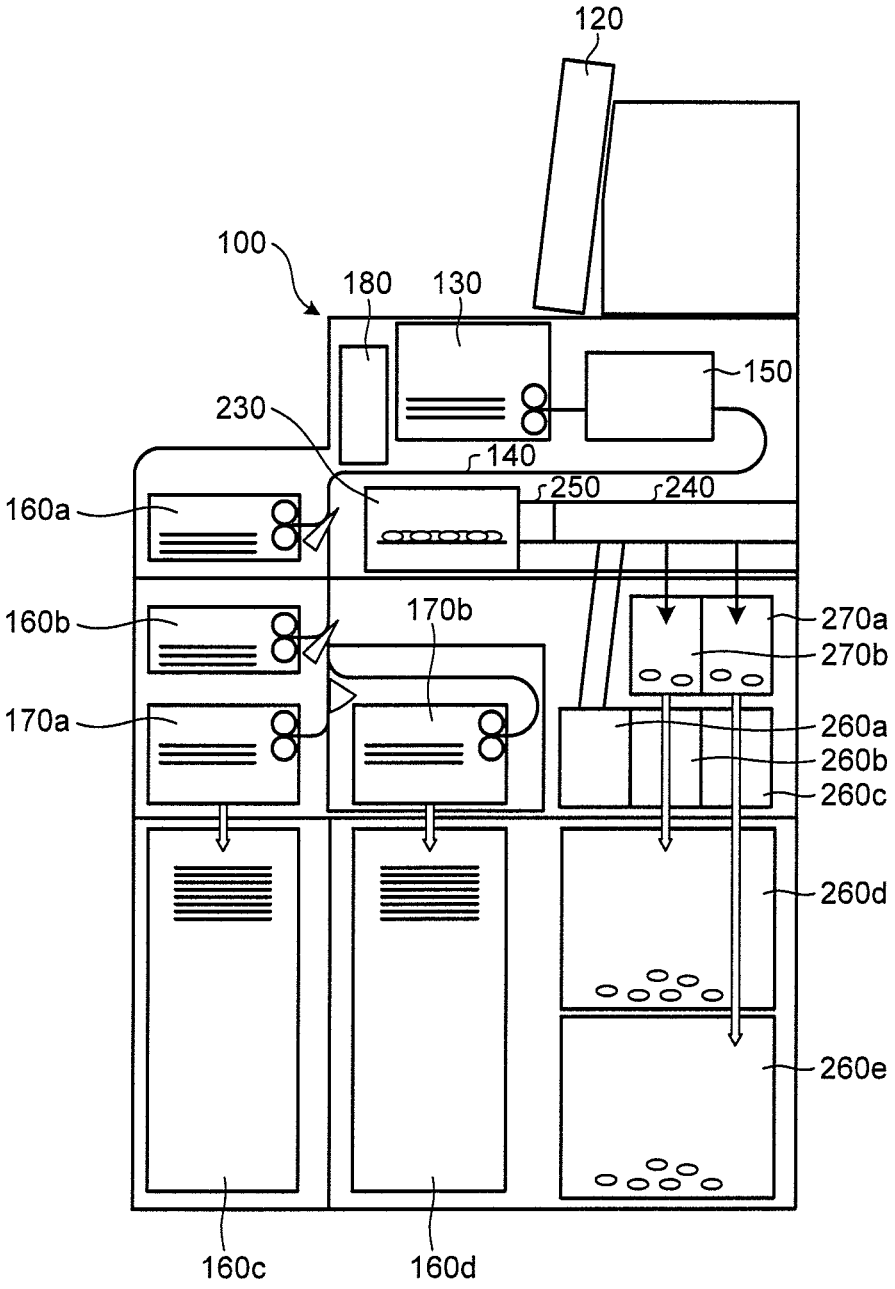
FIG. 6 is a schematic cross section showing an internal configuration of the money depositing apparatus when seen from the right side.

An example of collecting data from the error note in a money depositing apparatus capable of handling banknotes, gift certificates, and coins is explained below. FIG. 5 is a block diagram of a functional configuration of a money depositing apparatus (paper sheet handling apparatus) 100 according to a second embodiment. FIG. 6 is a schematic cross section showing an internal configuration of the money depositing apparatus 100 when seen from the right side.

As shown in FIG. 5, the money depositing apparatus 100 includes a paper sheet handling unit 101, a coin handling unit 201, an operation/display unit 120, a printer 180, a memory 300, and a control unit 110 that controls these all components. The paper sheet handling unit 101 is a unit that handles the banknotes and gift certificates. The paper sheet handling unit 101 includes a paper sheet receiving unit 130, a paper sheet transport unit 140, a paper sheet recognition unit 150, a paper sheet stacking unit 160, and a paper sheet temporarily stacking unit 170. The coin handling unit 201 is a unit that handles the coins. The coin handling unit 201 includes a coin receiving unit 230, a coin transport unit 240, a coin recognition unit 250, a coin stacking unit 260, and a coin temporarily stacking unit 270.

The operation/display unit 120 and the memory 300 have the same functions as the operation/display unit 20 and the memory 80 of the banknote handling apparatus 10 according to the first embodiment. However, in the memory 300, gift certificate data 320 is stored in addition to banknote data 310 corresponding to the data stored in the memory 80. The banknote data 310 includes data for banknote recognition 311, error banknote data 312, and error banknote data management information 313 respectively corresponding to the data for recognition 81, the error note data 82, and the error note data management information 83 shown in FIG. 1. Similarly, the gift certificate data 320 includes data for gift certificate recognition 321 to recognize the type, the authenticity, and the like of the gift certificate, error gift certificate data 322 including data collected from a gift certificate that was determined to be the error note, and error gift certificate data management information 323 including monitoring data relating to the moving and the copying of the error gift certificate data 322.

The paper sheet stacking unit 160 includes a paper sheet reject unit 160*a*, a gift certificate stacker 160*b*, a gift certificate stacking unit 160*c*, and a banknote stacking unit 160*d* shown in FIG. 6. The paper sheet temporarily stacking unit 170 includes a gift certificate temporarily stacking unit 170*a* and a banknote temporarily stacking unit 170*b*. The coin stacking unit 260 includes a coin reject unit 260*a*, coin return boxes 260*b* and 260*c*, and coin stacking units 260*d* and 260*e*. The coin temporarily stacking unit 270 includes two coin temporarily stacking units 270*a* and 270*b*.

The paper sheet reject unit 160*a* and the gift certificate stacker 160*b* are open on the apparatus front surface side (left side in FIG. 6), and the paper sheet stacked therein can be taken out from the opening. The gift certificate temporarily stacking unit 170*a* and the banknote temporarily stacking unit 170*b* can be pulled out from the apparatus front surface side. Also, the gift certificate stacking unit 160*c* and the banknote stacking unit 160*d* can be pulled out from the apparatus front surface side. Although the apparatus configuration is shown in a plane view in FIG. 6, actually, the coin handling unit 201 is arranged on the side of the paper sheet handling unit 101. The user can insert a coin in the coin receiving unit 230 and can take out a coin rejected in the coin reject unit 260*a* from the apparatus front surface side. Each of the coin return boxes 260*b* and 260*c* and the coin stacking units 260*d* and 260*e* can be pulled out from the apparatus front surface side.

The money depositing process of the banknote and the gift certificate will be explained first. The paper sheet (banknote or gift certificate) inserted in the paper sheet receiving unit 130 is fed one by one from the paper sheet receiving unit 130 and transported by the paper sheet transport unit 140 to the paper sheet recognition unit 150. If the transported paper sheet is a banknote, the paper sheet recognition unit 150 recognizes the denomination and the like of the banknote by using the data for banknote recognition 311. If the transported paper sheet is a gift certificate, the paper sheet recognition unit 150 recognizes the type and the like of the gift certificate by using the data for gift certificate recognition 321. Based on the recognition result obtained by the paper sheet recognition unit 150, if the paper sheet is determined to be a paper sheet that cannot be recognized, a counterfeit paper sheet, a suspect paper sheet that may be counterfeit, and the like, the paper sheet is stacked in the paper sheet reject unit 160*a* as the reject paper sheet. On the other hand, a normal banknote is stacked in the banknote temporarily stacking unit 170*b*, and a normal gift certificate is stacked in one of the gift certificate stacker 160*b* and the gift certificate temporarily stacking unit 170*a*.

The printer 180 is arranged downstream of the paper sheet recognition unit 150 in the transport direction. When the gift certificate is recognized as a normal gift certificate by the paper sheet recognition unit 150, nullification information indicating that the gift certificate has been already used can be printed by the printer 180 on the used gift certificate.

Whether the normal gift certificate is transported to the gift certificate stacker 160*b* or the gift certificate temporarily stacking unit 170*a* is determined based on the type of the gift certificate set previously. Specifically, a gift certificate that is to be immediately taken out from the money depositing apparatus 100 and processed is stacked in the gift certificate stacker 160*b* so that the gift certificate can be taken out from the opening thereof. In contrast, a gift certificate that is to be stored in the money depositing apparatus 100 is stacked in the gift certificate temporarily stacking unit 170*a* before stacking in the gift certificate stacking unit 160*c*. For example, a gift certificate issued by the shop in which the money depositing apparatus 100 is installed is stacked in the gift certificate stacker 160*b*, and a gift certificate issued by other shop and the like is stacked in the gift certificate temporarily stacking unit 170*a*.

When an operation to confirm money depositing process of the banknote is performed by using the operation/display unit 120, the banknotes temporarily stacked in the banknote temporarily stacking unit 170*b* are stored in the banknote stacking unit 160*d*. Similarly, when an operation to confirm money depositing process of the gift certificate is performed by using the operation/display unit 120, the gift certificates temporarily stacked in the gift certificate temporarily stacking unit 170*a* are stored in the gift certificate stacking unit 160*c*. On the other hand, when the money depositing process is canceled, the user can pull the gift certificate temporarily stacking unit 170*a* and the banknote temporarily stacking unit 170*b* toward the apparatus front surface side and collect the temporarily stacked gift certificates and/or the banknotes.

The money depositing process of the coin will be explained next. The coin inserted in the coin receiving unit 230 is fed one by one to the transport path and transported by the coin transport unit 240. The denomination and the like of the coin are recognized by the coin recognition unit 250. The coin is stored in one among the coin reject unit 260*a*, and the coin temporarily stacking units 270*a* and 270*b* based on the recognition result obtained by the coin recognition unit 250. The coins in the coin reject unit 260*a* can be collected by pulling the coin reject unit 260*a* toward the apparatus front surface side. The type of the coin, such as the denomination of the coin, to be stored in each of the two coin temporarily stacking units 270*a* and 270*b* can be set previously.

When an operation to confirm money depositing process of the coin is performed by using the operation/display unit 120, the coins temporarily stacked in the coin temporarily stacking units 270*a* and 270*b* are stored in the coin stacking units 260*d* and 260*e*, respectively. On the other hand, when the money depositing process of the coin is canceled, the coins temporarily stacked in the coin temporarily stacking units 270*a* and 270*b* are stored in the coin return boxes 260*b* and 260*c*, respectively. The coins in the coin return boxes 260*b* and 260*c* can be collected by pulling the coin return boxes 260*b* and 260*c* toward the apparatus front surface side.

In the paper sheet handling unit 101 of the money depositing apparatus 100, like in the banknote handling apparatus 10, in addition to the usual money depositing process, the error note data collection processing to acquire the data of the error note can be performed. In the money depositing apparatus 100, the banknote and the gift certificate can be processed as the paper sheet. The error note data collection processing, of which the processing target is the banknotes, is performed in the same manner as in the banknote handling apparatus 10.

Specifically, in the usual money depositing process of the banknotes, when the banknotes to be deposited are inserted in the paper sheet receiving unit 130 and the process is started, the paper sheet recognition unit 150 performs the recognition and counting of each of the banknotes by using the data for banknote recognition 311 prepared previously in the memory 300. The money depositing process is performed based on the total amount of the banknotes. On the other hand, when performing the error note data collection processing after selecting one of the all notes mode, the reject mode, and the accept mode, when the banknotes that are the error notes are inserted in the paper sheet receiving unit 130 and the process is started, the paper sheet recognition unit 150 collects various data from each of the error notes. The data acquired from the error note is stored in the memory 300 as the error banknote data 312. Moreover, an operation to move or copy the error banknote data 312 is monitored, and an operation history is recorded as the error banknote data management information 313.

Various processes performed in the error note data collection processing, the type of the data to be acquired, setting of the acquisition method of the data, and control of the transport speed, and the like for the banknotes are to the same as that explained for the banknote handling apparatus 10 by referring to FIGS. 1 to 4. In the money depositing apparatus 100, however, a stacking destination of the normal banknote in the usual money depositing process is set different from a stacking destination of the normal banknotes in the error note data collection processing. Specifically, in the usual money depositing process of the banknotes, the reject banknote is stacked in the paper sheet reject unit 160*a* and the normal banknote is stacked in the banknote stacking unit 160*d* after passing through the banknote temporarily stacking unit 170*b*. In contrast, in the error note data collection processing, the reject banknote is stacked in the paper sheet reject unit 160*a* like in the usual money depositing process of the banknotes, and the normal banknote is stacked in the gift certificate stacker 160*b*. Because the error note data collection processing is not for depositing money, even if a banknote is determined to be normal by the paper sheet recognition unit 150, this banknote is discharged to the outside of the apparatus from the gift certificate stacker 160*b* without storing in the banknote stacking unit 160*d*.

The usual money depositing process of the gift certificates, in which the processing target of the money depositing process is the gift certificate, is performed in the same manner as in the case of the banknote. Specifically, when the gift certificates to be deposited are inserted in the paper sheet receiving unit 130 and the process is started, the paper sheet recognition unit 150 recognizes the type of each of the gift certificates by using the data for gift certificate recognition 321 prepared previously in the memory 300. The money depositing process is performed based on an amount read from the gift certificate or an amount of the gift certificate input manually. On the other hand, when it is determined that the type of the gift certificate cannot be recognized by the paper sheet recognition unit 150 though data for recognition of this gift certificate has been already registered in the data for gift certificate recognition 321, or when a wrong recognition result is obtained, this gift certificate is regarded as the error note and the error note data collection processing is performed. When the gift certificate is the processing target, like in the case of the banknote, the error note data collection processing is performed after selecting one of the all notes mode, the reject mode, and the accept mode.

When performing the error note data collection processing for the gift certificate which is the processing target, the various data are collected from this error note. It is determined whether the correct recognition result can be obtained for this gift certificate that was determined to be the error note if the existing data for gift certificate recognition 321 is updated by using the data collected from this gift certificate.

If the correct recognition result can be obtained for all the gift certificates including the gift certificate, which was determined to be the error note, by updating the existing data for gift certificate recognition 321 by using the data acquired from the error note, the update of the data for gift certificate recognition 321 is performed. Thereafter, information indicating that the update of the data for gift certificate recognition 321 was performed and information that indicates the contents of the update are recorded in the error gift certificate data management information 323, and the data collected from the error note is discarded.

On the other hand, if the correct recognition result is not obtained from the gift certificate that was determined to be the error note even after updating the existing data for gift certificate recognition 321 by using the data collected from the error note, or if the correct recognition result is not obtained in other gift certificates when the existing data for gift certificate recognition 321 is updated, the data for gift certificate recognition 321 is not updated. In this case, like in the case of the banknote, the data collected from the error note is stored in the memory 300 as the error gift certificate data 322. Like in the case of the banknote, an operation to perform the moving or copying of the error gift certificate data 322 is monitored, and an operation history is recorded as the error gift certificate data management information 323.

A concrete example of the error note data collection processing with the gift certificate as the processing target is explained below. In the error note data collection processing, each of a plurality of error notes can be sequentially processed as the processing target. However, because the process performed for each of the error notes is the same, a flow of process for one error note as the processing target is explained below. The error note of the gift certificate is, for example, a gift certificate that is wrongly determined to be not a gift certificate of a type X and rejected though it is actually the gift certificate of the type X, a gift certificate that is wrongly determined as a gift certificate of a type X and accepted though it is actually not the gift certificate of the type X, and the like. In the following explanation, an explanation is given with the gift certificate that cannot be recognized as the gift certificate of the type X and is wrongly determined as not the gift certificate of the type X though it is actually the gift certificate of the type X as an example.

Figure 7:
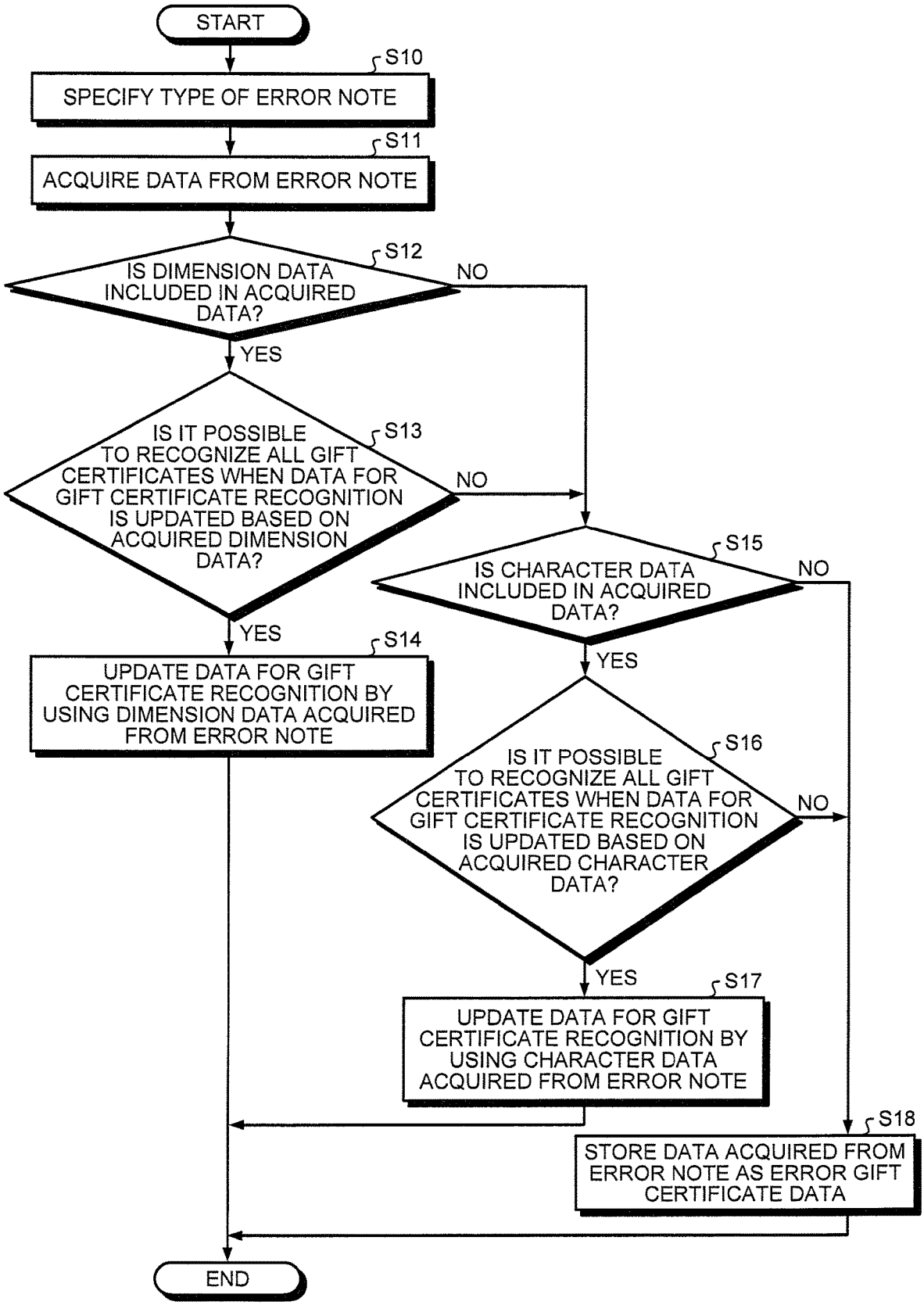
FIG. 7 is a flowchart of an error note data collection processing that processes a gift certificate as a processing target.

FIG. 7 is a flowchart of the error note data collection processing that processes the gift certificate as a processing target. After having started the error note data collection processing, at first, the operation/display unit 120 is operated and the type of the gift certificate that was determined to be the error note is specified (Step S10). Then, the gift certificate that is the error note is inserted in the paper sheet receiving unit 130 of the money depositing apparatus 100, and the processing mode is selected. Specifically, when the error note is the gift certificate of the type X for which the correct recognition result indicating the gift certificate of the type X is not obtained, the gift certificate of the type X is specified on the operation/display unit 120. Then, the error note is inserted in the paper sheet receiving unit 130, and the error note data collection processing is started in the all notes mode or the reject mode.

The error note inserted in the paper sheet receiving unit 130 is transported by the paper sheet transport unit 140. The paper sheet recognition unit 150 collects various data from the error note being transported by the paper sheet transport unit 140 (Step S11). By the paper sheet recognition unit 150, depending on the setting contents, like in the case of the recognition unit 50 according to the first embodiment, in addition to an image of the gift certificate, data on the size, the thickness, the magnetic characteristics, the ultraviolet light characteristics, the infrared light characteristics, and the like of the gift certificate can be acquired from an entire or a partial area of the gift certificate.

The control unit 110 of the money depositing apparatus 100 confirms whether dimension data, such as a short edge length, a long edge length, and a thickness of the error note, is included in the data collected by the paper sheet recognition unit 150 (Step S12). When the dimension data is included (Step S12: Yes), the control unit 110 determines whether it is possible to recognize all the gift certificates including the error note when the data for gift certificate recognition 321 is updated by changing the dimension data of the gift certificate of the type X included in the data for gift certificate recognition 321 to the acquired dimension data (Step S13). The dimension data used to update the data for gift certificate recognition 321 can include one of the long edge length, the short edge length, and the thickness. Alternatively, the dimension data can include any two selected from these, or can include all the three of these.

Specifically, the dimension data included in the data for gift certificate recognition 321 is changed so that the recognition result that the error note is the gift certificate of the type X is obtained when the dimension data acquired from the error note is compared with the dimension data of the type X included in the updated data of the data for gift certificate recognition 321. Then, it is confirmed whether, by this change, there is a case where the gift certificate is mistakenly determined as the gift certificate of the type X though it is actually not the gift certificate of the type X. That is, it is confirmed that the updating of the data for gift certificate recognition 321 does not affect the recognition result of the gift certificate of the types other than the type X.

If it is possible to correctly recognize all the gift certificates including the gift certificate of the type X by updating the data for gift certificate recognition 321 based on the dimension data acquired from the error note (Step S13: Yes), the control unit 110 updates the data for gift certificate recognition 321 by using the acquired dimension data (Step S14), and finishes the process. Specifically, the updated data of the data for gift certificate recognition 321 is stored in the memory 300 so that, from next time, the recognition process is performed by using the updated data for gift certificate recognition 321, and the process is finished.

For example, when the correct recognition result is not obtained and the gift certificate is determined to be the error note because the size and/or the thickness of the gift certificate is changed, and it is possible to recognize all the gift certificates including this gift certificate by simply changing the determination criteria relating to the size and/or the thickness of this gift certificate in the data for gift certificate recognition 321, the data for gift certificate 321 is updated.

On the other hand, when the dimension data is not included in the data acquired from the error note (Step S12: No), or when it is not possible to correctly recognize all the gift certificates even if the data for gift certificate recognition 321 is updated based on the acquired dimension data (Step S13: No), the control unit 110 confirms whether character data is included in the data acquired from the error note (Step S15).

Specifically, for example, when the overall size of the gift certificate cannot be identified as an image of the entire gift certificate cannot be captured by the paper sheet recognition unit 150 because the error note is too big (Step S12: No), or when the gift certificate of the other type will be wrongly determined if the data for gift certificate recognition 321 is updated based on the size, such as the length and/or the thickness, acquired from the error note (Step S13: No), a character recognition process is performed in the image of the error note to confirm the presence/absence of a character string printed on the error note (Step S15).

When a position and a size of the character string printed on the error note is successfully acquired (Step S15: Yes), the control unit 110 takes this data as character data and confirms whether it is possible to correctly recognize all the gift certificates including the error note when the data for gift certificate recognition 321 is updated based on the position and the size of the character string (Step S16). For example, a surface area of a rectangle where the character string printed on the gift certificate is inscribed is used as the size of character string.

Specifically, the data for gift certificate recognition 321 is updated so that the recognition result that the gift certificate is the gift certificate of the type X is obtained when the position and the size of the character string acquired from the error note is compared with character data of the gift certificate of the type X included in the data for gift certificate recognition 321. Then, it is confirmed whether, by this change, there is a case where the gift certificate is mistakenly recognized as the gift certificate of the type X though it is actually not the gift certificate of the type X. That is, it is confirmed that the updating of the data for gift certificate recognition 321 does not affect the recognition result of the gift certificate of the types other than the type X.

If it is possible to correctly recognize all the gift certificates including the gift certificate of the type X by updating the data for gift certificate recognition 321 based on the character data acquired from the error note (Step S16: Yes), the control unit 110 updates the data for gift certificate recognition 321 by using the acquired character data (Step S17), and finishes the process. Specifically, the updated data of the data for gift certificate recognition 321 is stored in the memory 300 so that, from next time, the recognition process is performed by using the updated data for gift certificate recognition 321, and the process is finished.

For example, when the correct recognition result is not obtained and the gift certificate is determined to be the error note because the size and/or the position of the character string printed on the gift certificate is changed, and it is possible to recognize all the gift certificates including this gift certificate by simply changing the determination criteria relating to the size and/or the position of the character string printed on the gift certificate in the data for gift certificate recognition 321, the data for gift certificate 321 is updated.

When the character data is not included in the data acquired from the error note (Step S15: No), or when it is not possible to correctly recognize all the gift certificates including the error note if the data for gift certificate recognition 321 is updated based on the acquired character data (Step S16: No), the control unit 110 does not update the data for gift certificate recognition 321 in the memory 300, stores all the data collected from the error note in the memory 300 as the error gift certificate data 322 (Step S18), and finishes the process.

In this case, like in the case where the error note is the banknote, until the data is collected by the manufacturer, the control unit 110 stores and manages the error gift certificate data 322 in the memory 300. The control unit 110 monitors the operation to move or copy the error gift certificate data 322 and records an operation history in the error gift certificate data management information 323. The manufacturer collects the error gift certificate data 322 from the money depositing apparatus 100 and investigates the details of the data, and generates the updated data of the data for gift certificate recognition 321.

In the same manner as the banknote as shown in FIG. 4, the error gift certificate data 322 stored in the memory 300 includes an acquisition date and time, an acquisition mode, apparatus information, information on the data for recognition, a recognition result, and acquired data. Moreover, an operation date and time and an operator ID are recorded in the error gift certificate data management information 323 when moving or copying of the error gift certificate data 322 is performed.

When the error note is the gift certificate that is wrongly determined to be the gift certificate of the type X though it is actually not the gift certificate of the type X, it is also processed in the same manner. For example, when an error note is wrongly determined to be the gift certificate of the type X though the error note is actually a new gift certificate of which data has not been registered in the data for gift certificate recognition 321, it is determined whether all the gift certificates can be correctly recognized by adding in the data for gift certificate recognition 321 the type of this new gift certificate and new data relating to the dimension data of this new gift certificate at Step 13. At Step S16, it is determined whether all the gift certificates can be correctly recognized by adding in the data for gift certificate recognition 321 the type of this new gift certificate and the character data, such as data relating to the position and the size of the character string printed on this new gift certificate. The other processes are performed in the same manner described above. In addition to the new gift certificate that is wrongly determined to be a gift certificate of other type, the new gift certificate that is rejected because it cannot be recognized can be processed in the same manner. By similarly processing such a new gift certificate with the error note data collection processing, update of the data for gift certificate recognition 321 or storing of the error gift certificate data 322 are performed.

When the error note is the gift certificate that is wrongly determined to be the gift certificate of the type X though it is actually a gift certificate of a type Y of which data for recognition has been already registered in the data for gift certificate recognition 321, it is determined whether all the gift certificates can be correctly recognized by changing one or both of the dimension data of the type X and dimension data of the type Y included in the data for gift certificate recognition 321 so that the error note is correctly recognized to be the gift certificate of the type Y at Step 13. At Step S16, it is determined whether all the gift certificates can be correctly recognized by changing one or both of the character data of the type X and character data of the type Y included in the data for gift certificate recognition 321 so that the error note is correctly recognized to be the gift certificate of the type Y. The other processes are performed in the same manner described above.

In FIG. 7, an example of updating the data for gift certificate recognition 321 by using one of the dimension data of the gift certificate and the character data including the position and the size of the character string printed on the gift certificate is explained; however, it is allowable to update the data for gift certificate recognition 321 by using both the data. Moreover, an example in which, after attempting the update of the data for gift certificate recognition 321 based on the dimension data, the attempt to update the data for gift certificate recognition 321 based on the character data is made is explained; however, the order can be reversed. Moreover, an example in which the character data includes data of a character string is explained; however, it is not limited to the character string, and a single character can suffice.

The data to be used to update the data for gift certificate recognition 321 is not limited to the dimension data and the character data. That is, the data to be used to update can be determined by the control unit 110.

Specifically, in the recognition process of this error note, after having specified the type of the error note at Step S10, the control unit 110 identifies data deviating from the determination criteria included in the data for gift certificate recognition 321. Then, the control unit 110 determines whether it is possible to recognize all the gift certificates including the error note by updating the data for gift certificate recognition 321 so as to change the determination criteria relating to the identified data.

Specifically, for example, when the data for gift certificate recognition 321 includes the determination criteria relating to a position, a size, a color, and the like of a mark printed on the gift certificate, and when the correct recognition result for this error note is not obtained because the color of the mark is different from the determination criteria set for the color, and there is no issue with respect to the position and the size of this mark, the control unit 110 recognizes this fact from the recognition result. Then, the control unit 110 changes the determination criteria of the mark that caused the wrong determination to include the color of the mark of the error note. Then, the control unit 110 determines whether it is possible to correctly recognize all the gift certificates including the error note by changing the determination criteria of the color. Upon determining that it is possible to correctly recognize all the gift certificates, the control unit 110 updates the data for gift certificate recognition 321.

Thus, in the money depositing apparatus 100 according to the present embodiment, when the error note is a banknote, the error note data collection processing is performed in the same manner as in the banknote handling apparatus 10 according to the first embodiment. Moreover, when the error note is a gift certificate, in the same manner as the banknote, the error gift certificate data 322 can be stored in the apparatus. Additionally, when it is possible to correctly recognize all the gift certificates including the error note by updating the data for gift certificate recognition 321 based on the data acquired from the error note, the data for gift certificate recognition 321 can be updated in the money depositing apparatus 100 without waiting for the investigation or the update of the data for recognition by the manufacturer of the money depositing apparatus 100.

INDUSTRIAL APPLICABILITY

As explained above, the paper sheet handling apparatus and the paper sheet handling method according to present invention is useful for easily collecting data for updating data for recognition from a paper sheet circulating in the market.

EXPLANATION OF REFERENCE NUMERALS

10 Banknote handling apparatus
20, 120 Operation/display unit
30 Receiving unit
40 Transport unit
50 Recognition unit
60, 60*a*, 60*b* Stacking unit
70, 110 Control unit
80, 300 Memory
100 Money depositing apparatus
101 Paper sheet handling unit
130 Paper sheet receiving unit
140 Paper sheet transport unit
150 Paper sheet recognition unit
160, 160*a* to 160*d* Paper sheet stacking unit
170, 170*a*, 170*b* Paper sheet temporarily stacking unit
180 Printer
201 Coin handling unit
230 Coin receiving unit
240 Coin transport unit
250 Coin recognition unit
260, 260*a* to 260*e* Coin stacking unit
270, 270*a*, 270*b* Coin temporarily stacking unit

The invention claimed is:

1. A banknote handling apparatus comprising:

a receiving unit configured to receive banknotes;

a memory configured to store therein template data for recognizing the banknotes;

a recognition unit configured in a first mode to acquire, from each banknote received in the receiving unit, data used for recognizing each banknote, and recognize each banknote based on comparison result between acquired data and the template data;

at least one stacker configured to stack the banknotes recognized by the recognition unit to separate genuine banknotes and counterfeit banknotes; and an operation unit configured to receive an instruction to switch an operation mode of the banknote handling apparatus from the first mode to a second mode for processing an error banknote that is not correctly recognized by the recognition unit in the first mode, wherein in the second mode processing, the recognition unit acquires, from the error banknote, data that indicates characteristics of the error banknote and is used for updating the template data, the acquired data including data that has not been acquired in the first mode processing and/or data that has been acquired but deleted in the first mode processing, and the memory stores therein the data acquired by the recognition unit in the second mode processing and keeps the stored data until the stored data is retrieved from the memory, the second mode includes a reject mode, in a case where the error banknote is a genuine banknote that has not been correctly recognized as genuine based on the template data in the first mode processing, the second mode is set to the reject mode and in the second mode processing of the reject mode, only the data acquired from banknotes, which are recognized as counterfeit banknotes and are rejected based on the template data, is kept in the memory.

2. The banknote handling apparatus as claimed in claim 1, wherein the acquired data in the second mode processing includes at least one of data on optical characteristics of the error banknote, data on magnetic characteristics of the error banknote and data on dimensional characteristics of the error banknote.

3. The banknote handling apparatus as claimed in claim 1, wherein the second mode includes an accept mode, in a case where the error banknote is a counterfeit banknote that has not been correctly recognized as counterfeit based on the template data in the first mode processing, the second mode is set to the accept mode, and in the second mode processing of the accept mode, only the data acquired from banknotes, which are recognized as genuine banknotes and accepted based on the template data, is kept in the memory.

4. The banknote handling apparatus as claimed in claim 1, wherein the second mode includes an auto mode, in the second mode processing of the auto mode, if a first banknote, from which the data is acquired by the recognition unit first in the second mode processing, is a banknote recognized to be rejected based on the template data, only the data acquired from banknotes recognized to be rejected based on the template data is kept in the memory, and if the first banknote is a banknote recognized not to be rejected based on the template data, only the data acquired from banknotes recognized not to be rejected based on the template data is kept in the memory.

5. The banknote handling apparatus as claimed in claim 1, wherein, the number of banknotes, from which the recognition unit acquires the data in the second mode processing, is limited to a predetermined number of banknotes.

6. The banknote handling apparatus as claimed in claim 1, further comprising a display unit configured to display information, wherein the second mode includes a manual mode, in the second mode processing of the manual mode, information on each banknote, from which the data is acquired by the recognition unit, is displayed on the display unit, and the data of the error banknote selected from among the banknotes, of which the information is displayed on the display, is kept in the memory.

7. The banknote handling apparatus as claimed in claim 1, further comprising a control unit configured to perform an authentication process of an operator, and permit an operation to move and/or copy the data stored in the memory only in a case where the operator is authorized for the operation.

8. The banknote handling apparatus as claimed in claim 1, wherein the data that has been acquired by the recognition unit in the second mode processing and stored in the memory is being encrypted.

9. The banknote handling apparatus as claimed in claim 1, further comprising a control unit configured to monitor an operation to move and/or copy the data from the memory and record information on the operation.

10. The banknote handling apparatus as claimed in claim 1, wherein, after the data that has been acquired by the recognition unit in the second mode processing and stored in the memory is collected by a manufacturer of the banknote handling apparatus, the data is deleted from the memory.

11. A banknote handling method implemented in a banknote handling apparatus, comprising switching an operation mode of the banknote handling apparatus from a first mode to a second mode to perform a second mode processing for processing an error banknote, which is not recognized correctly in the first mode based on template data previously prepared for the first mode, wherein the first mode processing includes:

receiving a banknote in the banknote handling apparatus;

acquiring, from the banknote, data used for recognizing the banknote, comparing acquired data with the template data previously prepared for recognizing banknotes and recognizing the banknote based on comparison result; and stacking the banknote in a corresponding stacker to separate genuine banknotes and counterfeit banknotes based on recognition result and the second mode processing includes:

receiving the error banknote;

acquiring, from the error banknotes, data that is used for updating the template data and indicates characteristics of the error banknote, the data to be acquired including data that is not acquired in the first mode and/or data that is acquired but deleted in the first mode;

storing in a memory, the acquired data and keeping the stored data until the stored data is retrieved from the memory; and stacking the error banknote in a corresponding stacker wherein the second mode includes a reject mode, in a case where the error banknote is a genuine banknote that has not been correctly recognized as genuine based on the template data in the first mode processing, the second mode is set to the reject mode and in the second mode processing of the reject mode, only the data acquired from banknotes, which are recognized as counterfeit banknotes and rejected based on the template data, is kept in memory.

12. A banknote handling apparatus comprising:

a receiving unit configured to receive banknotes;

a memory configured to store therein template data for recognizing the banknotes;

a recognition unit configured in a first mode to acquire, from each banknote received in the receiving unit, data used for recognizing each banknote, and recognize each banknote based on comparison result between acquired data and the template data;

at least one stacker configured to stack the banknotes recognized by the recognition unit to separate genuine banknotes and counterfeit banknotes; and an operation unit configured to receive an instruction to switch operation mode of the banknote handling apparatus from the first mode to a second mode for processing an error banknote that is not correctly recognized by the recognition unit in the first mode, wherein in the second mode processing, the recognition unit acquires, from the error banknote, data that indicates characteristics of the error banknote and is used for updating the template data, the acquired data including data that has not been acquired in the first mode processing and/or data that has been acquired but deleted in the first mode processing, and the memory stores therein the data acquired by the recognition unit in the second mode processing and keeps the stored data until the stored data is retrieved from the memory, the second mode includes an accept mode, in a case where the error banknote is a counterfeit banknote that has not been correctly recognized as counterfeit based on the template data in the first mode processing, the second mode is set to the accept mode, and in the second mode processing of the accept mode, only the data acquired from banknotes, which are recognized as genuine and accepted based on the template data, is kept in the memory.

* * * * *